United States Patent [19]

Kojima et al.

[11] 4,282,738

[45] Aug. 11, 1981

[54] METHOD AND APPARATUS FOR ADJUSTING STROKE LENGTH OF A RAM FOR PRESSES

[75] Inventors: Shigenori Kojima, Tokyo; Katsumi Koyama, Hiratsuka, both of Japan

[73] Assignee: Amada Company, Limited, Kanagawa, Japan

[21] Appl. No.: 26,367

[22] Filed: Apr. 2, 1979

[30] Foreign Application Priority Data

Mar. 31, 1978 [JP] Japan ..... 53-37529

[51] Int. Cl.[3] ..... B21D 5/02

[52] U.S. Cl. ..... 72/389; 72/441

[58] Field of Search ..... 72/441, 389, 386, 22; 100/256, 257

[56] References Cited

U.S. PATENT DOCUMENTS

| | | | |
|---|---|---|---|
| 2,797,724 | 7/1957 | Walldow | 72/22 |
| 3,534,679 | 10/1970 | Forichon | 72/441 |
| 3,633,395 | 1/1972 | Anderson | 72/22 |
| 3,841,140 | 10/1974 | Hryc | 72/441 |
| 3,874,205 | 4/1975 | Roch | 72/441 |

*Primary Examiner*—Gene P. Crosby

*Attorney, Agent, or Firm*—Wigman & Cohen

[57] ABSTRACT

This invention relates to a method and apparatus for adjusting a stroke length of a ram for a press. The stroke length of the ram is adjusted with respect to a base point. The hydraulic pressure level in the acting chanber is also adjusted. The press is generally used for bending metal sheets. By this invention, an optimum stroke length of the ram in the press can be easily determined without experimentally processing and, therefore, wasting sheet metal workpieces.

2 Claims, 4 Drawing Figures

METHOD AND APPARATUS FOR ADJUSTING STROKE LENGTH OF A RAM FOR PRESSES

BACKGROUND OF THE INVENTION

1. Field of the Invention

The present invention relates generally to presses such as press brakes for bending sheet metals, and more particularly to a method and an apparatus for adjusting the stroke length of a ram for presses.

2. Description of the Prior Art

In presses, it is necessary to adjust the stroke length of a ram holding a tool or tools, according to materials and dimensions of workpieces to be formed or processed, dimensions and shapes to be made or formed on workpieces, and dimensions of tools to be used on presses. It is very difficult and time-consuming to adjust the stroke length of a ram in presses, since a slight error in setting the stroke length of a ram will cause bad finishes on workpieces to be formed or processed by the press.

Heretofore, various attempts have been made to adjust the stroke length of a ram in presses, but all of the conventional measures have suffered from serious shortcomings. For example, a micro switch means is used to define the stroking limit of a ram in presses, and such a micro switch means is adjusted to adjust the stroke length of the ram. In this case, when it is desired to change the tools of the press for other ones of different dimensions, it is necessary to accurately calculate the differences in the dimensions of the tools. In any of the conventional manners, it has been impossible to adjust the stroke length of a ram in presses by taking into account deflections which will be produced on presses in operations, and accordingly it has been necessary to determine the stroke length of a ram by trial and error by experimentally processing workpieces. Also, when it is desired to reuse worn tools after regrinding them, it is difficult and time-consuming to calculate the reduction in dimensions of the tools in order to determine the stroke length of the ram in the conventional manner. Also, it has been very difficult to correct the stroke length of a ram in a press in the conventional manner, when the frame of the press is subject to deflection because of a change in temperature. Such being the case, the stroke length of a ram in presses has been determined by trial and error by experimentally processing workpieces, and a number of workpieces are scrapped before an acceptable stroke length can be obtained.

SUMMARY OF THE INVENTION

It is an object of the present invention to provide a method and an apparatus in which an optimum stroke length of a ram in presses can be easily obtained to use tools of different dimensions without calculating the stroke length.

It is another object of the present invention to provide a method and an apparatus in which an optimum stroke length of a ram in presses can be easily determined without experimentally processing workpieces to compensate for deflections produced on presses during operations.

It is another object of the present invention to provide a method and an apparatus in which an original or base point for measuring the stroke length of a ram in a press can be set with the press subjected to deflection which will be produced thereon in actual operation.

It is a further object of the present invention to provide a method and an apparatus in which accurate finishes can be obtained and excessive loads can be eliminated in operations of presses.

Other and further objects and advantages of the present invention will be apparent from the following description and accompanying drawings which, by way of illustration, show preferred embodiments of the present invention.

DESCRIPTION OF THE PREFERRED EMBODIMENTS

Figure 1:
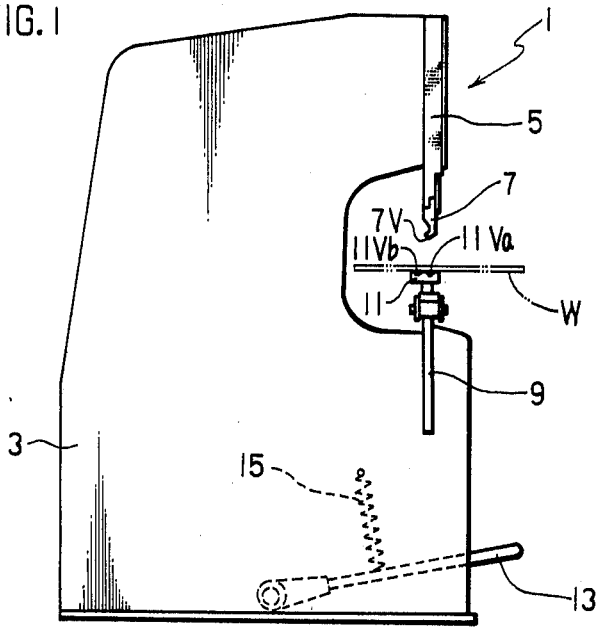
FIG. 1 is a side view of a hydraulic press brake embodying the principles of the present invention.

Referring now to FIG. 1, the present invention will be described as embodied in a hydraulic press brake (generally designated by the numeral) 1 which is a kind of press for bending workpieces such as sheet metals and is constructed of a C-shaped frame 3. The hydraulic press brake 1 is provided at its front upper portion with a plate-like beam 5 (horizontally) fixed thereto, and an elongate upper tool or punch 7 is detachably fixed horizontally at the lower end of the plate-like beam 5. Also, the hydraulic press brake 1 is provided at its front lower portion with a vertical plate-like ram 9 which is movable toward and away from the upper tool 7, and an elongate lower tool or die 11 is detachably fixed horizontally at the top end of the ram 9. The upper tool 7 is formed at its bottom with a V-shaped bending edge 7V and the lower tool 11 is formed at its top surface with V-shaped bending grooves 11V*a* and 11V*b*. Either of the V-shaped bending grooves 11V*a* and 11V*b* of the lower tool 11 is alternatively located just under the V-shaped bending edge 7V of the upper tool 7 so that it may be brought into engagement with the V-shaped bending edge 7V when the ram 9 is raised, and therefore either of the V-shaped bending grooves 11V*a* and 11V*b* can be omitted. Thus, when the ram 9 is raised to bring the lower tool 11 toward the upper tool 7, the V-shaped bending edge 7V and either of the V-shaped bending grooves 11V*a* and 11V*b* (which is located just under the V-shaped bending edge 7V) will cooperate with each other to bend a work-sheet W such as a sheet metal plate which has been placed on the top of the lower tool 11, as shown by the imaginary lines in FIG. 2. Also, as will be described in great detail hereinafter, the ram 9 is so arranged that it will be raised when a pedal 13 provided at the lower portion of the press brake 1 is depressed and it will be lowered when the pedal 13 is swung up by a spring 15 biasing the pedal 13 upwardly.

In this connection, it is to be noted that the present invention is applicable to any suitable type of press, although the present invention has been described hereinbefore and will be described hereinafter with regard to the hydraulic press brake 1 for bending sheet metals. Of course, the present invention is applicable to presses in which a ram having an upper tool is so arranged as to be lowered to enable such an upper tool to work with a fixed lower tool to process workpieces, as will be understood as the description proceeds.

Figure 2:
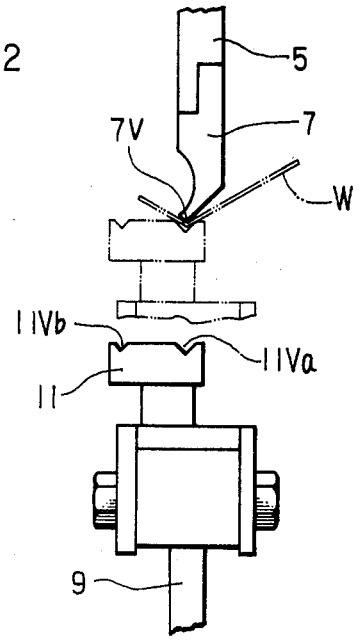
FIG. 2 is an enlarged partial view showing a portion of the hydraulic press brake shown in FIG. 1.

As seen from FIG. 2, an angle of a bend which is made on the work-sheet W by the upper and lower tools 7 and 11 is determined by the vertical position of the V-shaped bending grooves 11V*a* and 11V*b* of the lower tool 11 with regard to the V-shaped bending edge 7V of the upper tool 7. In other words, such an angle of a bend to be made on the work-sheet W is determined by the distance between the upper and lower tools 7 and 11 and more strictly by the upper stroking limit of the lower tool 11. As will be readily understood, the higher the upper stroking limit of the lower tool 11, the acuter the angle of a bend to be made on the work-sheet W, although of course no angle that is acuter than the angle(s) of the V-shaped bending groove(s) 11V*a* (and 11V*b*) can be made on the work-sheet W. Thus, it will now be understood that the angle of a bend to be made on the work-sheet W can be determined by controlling (or adjusting) the upper stroking limit or the stroke length of the ram 9 carrying the lower tool 11. Of course, it is necessary to adjust or control the upper stroking limit or the stroke length of the ram 11 for various purposes.

Figure 3:
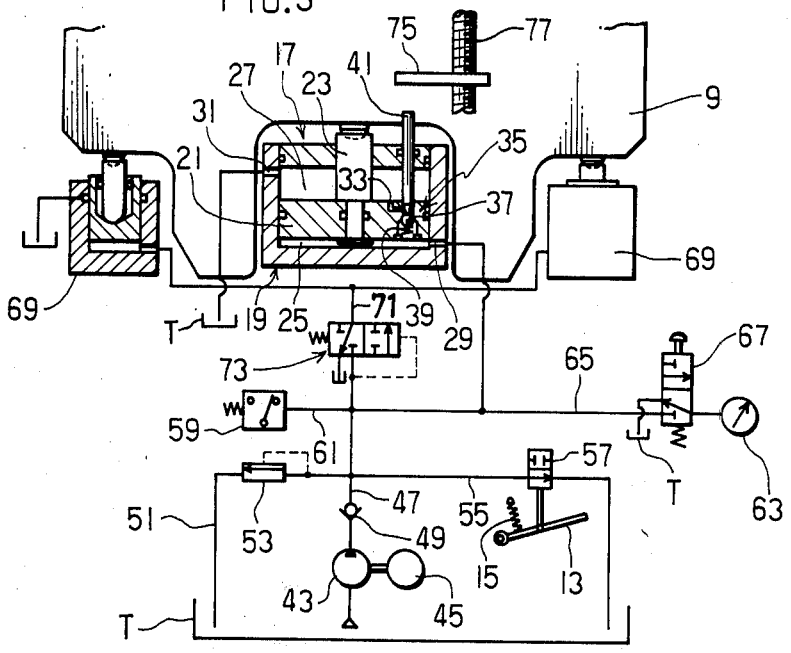
FIG. 3 is a schematic illustration showing an embodiment of the principles of the present invention.
Figure 4:
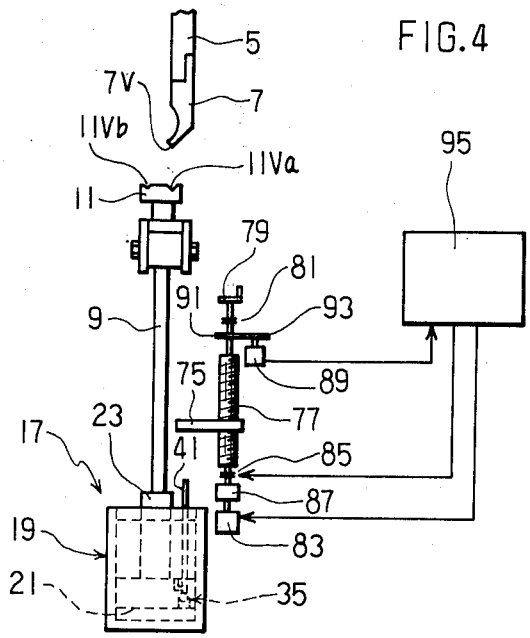
FIG. 4 is another schematic illustration showing the embodiment of FIG. 3.

Referring to FIGS. 3 and 4, the ram 9 is so arranged as to be raised and lowered by a driving means 17 which is a hydraulic motor comprising a hydraulic cylinder 19 and a piston 21 in the preferred embodiment. The piston 21 of the driving means 17 has a piston rod 23 which movably projects upwardly out of the cylinder 19 and is connected to the bottom of the ram 9, and also it divides the interior of the cylinder 19 into two chambers 25 and 27 which have ports 29 and 31, respectively. Thus, the ram 9 is raised by the piston 21 and the piston rod 23 to bring up the lower tool 11 toward the upper tool 7, when the hydraulic fluid is delivered into the chamber 25 of the hydraulic cylinder 19 through the port 29. Also, the ram 9 is lowered by its own gravity to bring down the lower tool 11 away from the upper tool 7, when the hydraulic fluid is exhausted out of the chamber 25 of the cylinder 19 through the port 29.

As best shown in FIG. 3, the piston 21 of the driving means 17 is formed with a passage 33 connecting the chambers 25 and 27 of the hydraulic cylinder 19, and a check valve means 35 is so provided in the passage 33 as to normally block the hydraulic fluid from flowing into the chamber 27 from the chamber 25. The check valve means 35 is provided with a vertical push rod member 41 for pushing the valve member 37 against the spring member 39 to allow the hydraulic fluid to pass therethrough into the chamber 27 from the chamber 25 in the hydraulic cylinder 19. The push rod member 41 is vertically movably positioned in the chamber 27 of the hydraulic cylinder 19 in such a manner that its lower end rides on the valve member 37 and its upper portion slidably projects upwardly out of the hydraulic cylinder 19. Thus, when the push rod member 41 is depressed to push down the valve member 37 against the spring member 39, the valve member 37 will open the passage 33, and accordingly the hydraulic fluid will flow into the chamber 27 from the chamber 25 through the passage 33 and then go out of the hydraulic cylinder 19 through the port 31 to be drained. As is now readily apparent, the ram 9 being raised by the hydraulic fluid delivered into the chamber 25 of the hydraulic cylinder 19 will be stopped from being raised when the push rod member 41 is pushed to cause the valve member 37 to open the passage 33 against the spring member 39. Also, it will be readily understood that the hydraulic pressure for urging the piston rod 21 in the chamber 25 of the hydraulic cylinder 19 can be controlled by adjusting the opening of the valve member 37 in the passage 33 by adjusting the push rod member 41. Furthermore, it will be apparent to those skilled in the art that the check valve means 35 and the push rod member 41 can be provided outside of the hydraulic cylinder 19 in a suitable manner.

In order to supply the hydraulic cylinder 19 with the hydraulic fluid, a hydraulic pump 43 which is connected to a hydraulic tank T and is driven by a motor 45 is connected with the port 29 of the chamber 25 of the hydraulic cylinder 19 by a main conduit 47 which is provided with a check valve 49. As is conventional, the main conduit 47 is connected with the hydraulic tank T through a conduit 51 where a relief valve 53 is provided to drain the hydraulic fluid when the hydraulic pressure is extraordinarily increased in the main conduit 47. There is provided a conduit 55 which diverges from the main conduit 47 and leads to the hydraulic tank T through a distributor 57 which is connected with the pedal 13 provided at the lower portion of the hydraulic press brake 1. The distributor 57 is so arranged that it will normally allow the hydraulic fluid to flow therethrough from the main conduit 47 to the hydraulic tank T but it will block the same from being drained therethrough to the hydraulic tank T when the pedal 13 is depressed. Also, the main conduit 47 is provided with a pressure switch 59 which is connected thereto by a conduit 61 and is so arranged as to make a signal when the hydraulic fluid prevailing in the main conduit 47 has reached a predetermined pressure. The main conduit 47 is further provided with a pressure gauge 63 which is connected therewith through a conduit 65 and is protected from the abrupt rippling of the hydraulic fluid by a manually operated cutoff valve 67 when not used. Thus, when it is desired to watch the pressure gauge 63, the cutoff valve 67 is manually operated so as to lead the hydraulic fluid to the pressure gauge 63 from the main conduit 47. Also, in the preferred embodiment, the hydraulic press brake 1 is provided with subsidiary hydraulic motors 69 of a cylinder type for driving the ram 9, and the subsidiary hydraulic motors 69 are connected with the main conduit 47 by a conduit 71 through a sequence valve 73 which is of a two position type having four ports. The sequence valve 73 is so arranged as to normally close the conduit 71 and open the same to supply the subsidiary hydraulic motors 69 with the hydraulic fluid from the main conduit 47 when the hydraulic fluid has reached a predetermined pressure.

As is now apparent from the above description, the hydraulic fluid sent out by the pump 43 into the main conduit 47 from the hydraulic tank T is returned to the hydraulic tank T through the distributor 57 when the pedal 13 is not depressed to close the distributor 57. Therefore, when the pedal 13 is kept depressed, the hydraulic fluid sent out by the pump 43 into the main conduit 47 will act in the chamber 25 of the hydraulic cylinder 19 to cause the piston 21 and the piston rod 23 to raise the ram 9. However, once the pedal 13 is depressed to cause the distributor 57 to block the hydraulic fluid from flowing therethrough, the hydraulic fluid will be positively delivered into the chamber 25 of the hydraulic cylinder 19 from the port 29 to cause the piston 21 and the piston rod 23 to raise the ram 9. After the pedal 13 is depressed to prevent the hydraulic fluid from being drained through the distributor 57, the hydraulic fluid from the pump 43 will act only in the chamber 25 of the hydraulic cylinder 19 to raise the ram 9 until the lower tool 11 or the work-sheet W placed on the same is brought by the ram 9 into contact with the upper tool 7. However, once the ram 9 is raised to such an extent as to bring the lower tool 11 or the work-sheet W placed thereon into contact with the upper tool 7, the hydraulic pressure prevailing in the chamber 25 of the hydraulic cylinder 19 and the main conduit 47 will be increased to cause the sequence valve 73 to open the conduit 71 so that the hydraulic fluid will be delivered into the subsidiary hydraulic motors 69. After the hydraulic fluid has begun to act in the subsidiary hydraulic motors 69, the ram 9 will be slowed down from being raised but it will be raised with a larger force to enable the upper and lower tools 7 and 11 to bend the work-sheet W placed on the lower tool 11. Also, it will be understood that the ram 9 which has been raised can be lowered by its own gravity by depressing the pedal 13 to drain the hydraulic fluid through the distributor 57 to the hydraulic tank T.

As is also shown in FIGS. 3 and 4, a stopper member 75 is vertically movable just above the push rod member 41 which is so provided in the chamber 27 of the hydraulic cylinder 19 as to slidably project upwardly out of the same, as has been described hereinbefore. The stopper member 75 is so arranged as to be vertically moved toward and away from the push rod member 41 by a lead screw 77 which is vertically disposed at a portion of the frame 3 of the hydraulic press brake 1. The lead screw 77 is provided at its top with a handwheel 79 which is connected thereto by a clutch means 81 such as a dog clutch, and also it is connected at its lower end to a motor 83 through a magnetic clutch and brake means 85 and a reduction gear means 87. The motor 83 and the clutch and brake means 85 may be controlled as will be described hereinafter. Thus, the lead screw 77 is so arranged as to be rotated alternatively by either the handwheel 79 or the motor 83 so as to move the stopper member 75 toward and away from the push rod member 41.

As is readily apparent, the push rod member 41 will be brought into contact with the stopper member 75 when the piston 21 is raised by the hydraulic fluid in the chamber 25 of the hydraulic cylinder 19 to raise the ram 9. Also, once the push rod member 41 has been brought into contact with the stopper member 75, it will push the valve member 37 of the check valve means 35 to allow the hydraulic fluid to flow into the chamber 27 from the chamber 25 in the hydraulic cylinder 19 and as the result the ram 9 will be stopped from going up. Thus, it will be understood that the upper stroking limit of the ram 9 can be readily adjusted by rotating the lead screw 77 by either the handwheel 79 or the motor 83 to vertically move the stopper member 75 toward and away from the push rod member 41.

As shown in FIG. 4, the lead screw 77 is connected with a rotary encoder 89 by means of gears 91 and 93 which are fixed to the lead screw 77 and a shaft of the rotary encoder 89, respectively, and are in engagement with each other. The rotary encoder 89 is so designed as to generate pulses when rotated together with the lead screw 77, and it is electrically connected to a control means 95 such as a numerical control means which is connected to the motor 83 and the magnetic clutch and brake means 85 to control them. Thus, the rotary encoder 89 will generate pulses and transmit them to the control means 95 when rotated so as to inform the control means 95 of the rotation of the lead screw 77, namely, the vertical location of the stopper member 75.

The control means 95 is previously stored with data or information such as materials, thicknesses and widths of work-sheets W to be bent, angles of bends to be made on work-sheets W, and dimensions of tools to be used on the hydraulic press brake 1 by (means of) suitable means such as cards, tapes and switches. As a matter of great importance, the control means 95 is so arranged as to be additionally stored with an original measuring point from which the stroke length of the ram 9 is measured when it is necessary to change the upper and lower tools 7 and 11 for other ones of different dimensions. Also, the control means 95 is so arranged as to actuate the magnetic clutch and brake means 85 and control the motor 83 to rotate the lead screw 77 so as to bring the stopper member 75 to an optimum location for bending the work-sheet W on the basis of the stored data and according to the pulses transmitted from the rotary encoder 89. More particularly, the magnetic clutch and brake means 85 is driven by signals transmitted by the control means 95, and the motor 83 is driven under the control of the control means 95 to rotate the lead screw 77 when the magnetic clutch and brake means 85 keeps the lead screw 77 connected with the motor 83.

Also, the control means 95 may be connected with the pressure switch 59 so that it can receive signals when the hydraulic fluid prevailing in the main conduit 47 has reached a predetermined pressure, as will be described hereinafter. Furthermore, the control means 95 is so set that it may be possible to make corrections on the stored data by manually rotating the handwheel 79 or by inching the motor 83 when the control means 95 should fail to bring the stopper member 75 to an optimum position for bending the work-sheet W for one cause or another.

From the above description, it will be understood that the lead screw 77 can be rotated both manually by the handwheel 79 and automatically by the motor 83 under the control of the control means 95 and also strictly further with the motor 83 inched. As is readily apparent, when the lead screw 77 is rotated, the stopper member 75 is vertically moved toward and away from the push rod member 41 to adjust the stroke length or the upper stroking limit of the ram 9. Also, the control means 95 will control the clutch and brake means 85 and the motor 83 to rotate the lead screw 77 so as to adjust the stroke length or the upper stroking limit of the ram 9 according to the pulses transmitted by the rotary encoder 89 and on the basis of the stored data such as materials, thicknesses and widths of work-sheets W, angles of bends to be made on work-sheets W and dimensions of tools. Incidentally, it will be apparent to those skilled in the art that any other suitable means can be used for the rotary encoder 89 as a position recorder to detect the position of the stopper member 75.

According to the present invention, the stroke length of the ram 9 is measured as an original measuring point from a vertical point where the upper and lower tools 7 and 11 are kept completely engaged with each other by the hydraulic pressure without pressing the work-sheet W therebetween to such an extent as to produce a slight deflection within an elastic region on portions of the hydraulic press 1. More specifically, in order to adjust the stroke length or the upper stroking limit of the ram 9, the vertical location of the lower tool 11 is adjusted with regard to the original measuring point, that is, the vertical point where the upper and lower tools 7 and 11 are completely pressed with each other without pressing the work-sheet W to such an extent as to produce a slight deflection on the press brake 1. The original measuring point where the upper and lower tools 7 and 11 are in the complete engagement with each other can be detected when the hydraulic fluid prevailing in the chamber 25 of the hydraulic cylinder 19 and the main conduit 47 has been increased to a pressure which has been predetermined according to the capacity of the press brake 1. In other words, the hydraulic pressure which will keep the upper and lower tools 7 and 11 engaged with each other at the original measuring point has been so predetermined as to produce a slight deflection within the elastic limit on portions of the hydraulic press brake 1. Thus, when the hydraulic fluid has been increased to the predetermined pressure in the chamber 25 of the hydraulic cylinder 19 and the main conduit 47, a signal is transmitted to the control means 95 to store the same with the original measuring point for adjusting the stroke length of the ram 9. The hydraulic pressure which has been increased to such an extent as to urge the upper and lower tools 7 and 11 at the original measuring point can be detected by watching the pressure gauge 63, and it can be transmitted to the control means 95 to store the same with the original measuring point by manually operating a means such as a switch provided at the control means. Also, the pressure switch 59 may be so arranged as to transmit a signal to store the control means 95 with the original measuring point when the hydraulic pressure in the chamber 25 of the hydraulic cylinder 19 has been increased to urge the upper and lower tools 7 and 11 at the original measuring point. Thus, after having been stored with the original measuring point, the control means 95 will determine where the upper stroke limit of the ram 9 should be located with regard to the original measuring point according to a predetermined program, and then it will control the magnetic clutch and brake means 85 and the motor 83 to adjust the stroke length of the ram 9.

In operation, in order to adjust the stroke length of the ram 9, the pedal 13 is depressed to raise the ram 9 without placing the work-sheet W on the lower tool 11 in order to bring the lower tool 11 into complete engagement with the upper tool 7. When the push rod 41 is brought into contact with the stopper member 75 and pushes the valve member 37 of the check valve means 35 to stop the ram 9 from being raised, the lead screw 77 is rotated to bring up the stopper member 75 to enable the ram 9 to bring the lower tool 11 into engagement with the upper tool 7. When the lower tool 11 has been brought into engagement with the upper tool 7, the hydraulic fluid prevailing in the main conduit 47 will be increased in pressure so as to enable the sequence valve assembly 73 to open the conduit 71 to urge the subsidiary hydraulic motors 69 and, as a result, the ram 9 will be urged up with a larger force to press the lower tool 11 completely against the upper tool 7. Then, the hydraulic pressure in the chamber 25 of the hydraulic cylinder 19 and the main conduit 47 is adjusted by rotating the lead screw 77 to enable the stopper member 75 and the push rod member 41 to adjust the opening of the valve member 37 of the check valve means 35 in the passage 33 until the pressure gauge 63 indicates the predetermined pressure. When the predetermined pressure is indicated by the pressure gauge 63, the upper and lower tools 7 and 11 will be completely engaged with each other at the original measuring point, and therefore a signal is transmitted to the control means 95 to store the same with the original measuring point. Thereafter, the control means 95, stored with the original measuring point, will rotate the lead screw 77 to bring the stopper member 75 to an optimum vertical location to obtain an optimum stroke length of the ram 9 for bending the work-sheet W.

When it is desired to make several bends of different angles on each of the work-sheets W continuously, the control means 95 is stored with the order in which the bends of different angles are to be made. In this manner, each time when the upper and lower tools 7 and 11 have finished forming one of the bends on a work-sheet W, the control means 95 will reset the stroke length of the ram 9 to enable the upper and lower tools 7 and 11 to make another one of the bends to be formed next. Of course, after the upper and lower tools 7 and 11 have made all of the bends to be formed on one of the work-sheets W, the control means 95 will control the ram 9 to enable the upper and lower tool 7 and 11 to repeat another bending cycle on another work-sheet W.

As has been so far described, the original point for measuring the stroke length of the ram 9 is set, according to the present invention, at the vertical point where the upper and lower tools 7 and 11 are kept pressed to each other by the hydraulic fluid which is of a pressure producing a slight deflection within an elastic region on portions of the hydraulic press brake 1. In this arrangement, the stroke length of the ram 9 is set by taking into account the deflections which will be produced on portions of the hydraulic press brake 1 when the work-sheet W is being bent. Accordingly, the stroke length of the ram 9 can be most desirably determined so that accurate finishes may be obtained on the work-sheet W. Therefore, it is unnecessary to experimentally process or bend a number of work-pieces by trial and error in order to adjust the stroke length of the ram 9. Also, any portions of the hydraulic press brake 1 such as the upper and lower tools 7 and 11 will be never broken by an excessive hydraulic pressure, since the hydraulic pressure will not be increased to cause deflections above the elastic limit of portions of the hydraulic press brake 1. Of course, the stroke length of the ram 9 can be easily adjusted by resetting the original measuring point in any cases such as when it is desired to change the upper and lower tools 7 and 11 for other ones of different dimensions and when temperature deflections have occurred on portions of the hydraulic press brake 1. Also, in many cases, it is only necessary to reset the original measuring point to adjust the stroke length of the ram 9, and it is unnecessary to calculate the stroke length of the ram 9. Furthermore, the upper and lower tools 7 and 11 can be easily mounted on the hydraulic press brake 1 without especial alignment, since they are pressed to each other when the original measuring point is set to adjust the stroke length of the ram 9.

Although a preferred form of the present invention has been illustrated and described, it should be understood that the device is capable of modification by one skilled in the art without departing from the principles of the invention. Accordingly, the scope of the invention is to be limited only by the claims appended hereto.

We claim:

1. An apparatus for adjusting a stroke length of a ram for a press, comprising:

a ram;

a first tool held by the ram;

a frame aligned in opposition to the ram;

a second tool held by the frame;

hydraulic driving means for raising and lowering the ram;

rotary encoder means for detecting a point where said first and second tools are completely engaged with each other at a predetermined hydraulic pressure in the driving means;

control means for setting said point as a base point from which a stroke length of the ram is thereafter measurable with respect to said second tool, for storing said point as the base point, and for transmitting signals;

whereby the stroke length of the ram is adjusted with respect to said base point;

stopper means for stopping the ram at a desired position, said stopper means being adjustably provided on the frame;

a hydraulically acting chamber, provided in the driving means, for raising the ram;

check valve means for communicating with the acting chamber; and a push rod means for contacting the stopper means at one end and for pushing the check valve means at its other end;

whereby the hydraulic pressure level in the acting chamber is adjusted.

2. The apparatus, according to claim 1, further comprising:

means, provided on the frame, for holding the stopper means; and motor means for moving the stopper means along the holding means in response to the signals transmitted from the control means.

* * * * *